US010267587B2

(12) United States Patent
Hutson

(10) Patent No.: US 10,267,587 B2
(45) Date of Patent: Apr. 23, 2019

(54) ADJUSTABLE SIGHTING AND SHOOTING FIREARM MOUNTING VISE

(71) Applicant: Herman Hutson, Baton Rouge, LA (US)

(72) Inventor: Herman Hutson, Baton Rouge, LA (US)

( * ) Notice: Subject to any disclaimer, the term of this patent is extended or adjusted under 35 U.S.C. 154(b) by 0 days.

(21) Appl. No.: 16/012,585

(22) Filed: Jun. 19, 2018

(65) Prior Publication Data

US 2018/0299224 A1 Oct. 18, 2018

Related U.S. Application Data

(63) Continuation-in-part of application No. 15/625,880, filed on Jun. 16, 2017, now Pat. No. 10,024,621.

(60) Provisional application No. 62/350,808, filed on Jun. 16, 2016.

(51) Int. Cl.

| | |
|---|---|
| ***F41A 19/08*** | (2006.01) |
| ***F41A 27/22*** | (2006.01) |
| ***F41A 27/24*** | (2006.01) |
| ***F41A 27/28*** | (2006.01) |
| ***F41G 3/16*** | (2006.01) |
| ***F41G 3/26*** | (2006.01) |
| ***F41G 3/30*** | (2006.01) |
| ***F41G 5/06*** | (2006.01) |

(52) U.S. Cl.

CPC ..... *F41A 27/28* (2013.01); *F41A 19/08* (2013.01); *F41A 27/22* (2013.01); *F41A 27/24* (2013.01); *F41G 3/165* (2013.01); *F41G 3/26* (2013.01); *F41G 3/30* (2013.01); *F41G 5/06* (2013.01)

(58) Field of Classification Search

CPC ..... F41A 19/08; F41A 27/22; F41A 27/24; F41A 27/28; F41A 23/16; F41A 31/00

See application file for complete search history.

(56) References Cited

U.S. PATENT DOCUMENTS 4,012,860 A * 3/1977 Auger ..... F41A 23/16 42/94
4,333,385 A * 6/1982 Culver ..... F41A 23/16 73/167
5,272,955 A * 12/1993 Bond ..... F41A 23/58 89/37.04

(Continued)

*Primary Examiner* — Joshua T Semick

(57) ABSTRACT

An adjustable sighting and shooting firearm mounting vise receives a firearm to assist shooters with sighting and discharging the firearm. The firearm mounting vise includes a first base support, a second base support, a pair of positional-adjustment tracks, a forend support, a stock support, a trigger actuator, a trigger switch, a controller housing, a wireless receiver, and a microcontroller. The first base support and the second base support the pair of positional-adjustment tracks. The pair of positional-adjustment tracks allows the forend support, the stock support, and the trigger actuator to translate along each positional-adjustment track to accommodate a plurality of firearms to be secured by the firearm mounting vise. The controller housing protects electrical components including the microcontroller and the wireless receiver. The microcontroller receives control signals through the wireless receiver or directly from the trigger switch to activate the trigger actuator and discharging the firearm.

19 Claims, 11 Drawing Sheets

(56) References Cited

U.S. PATENT DOCUMENTS

| | | | | |
|---|---|---|---|---|
| 5,761,954 | A * | 6/1998 | Dvorak | G01L 5/22 73/167 |
| 6,237,462 | B1 * | 5/2001 | Hawkes | F41A 23/12 89/37.05 |
| 7,823,317 | B2 * | 11/2010 | Potterfield | F41A 23/16 248/121 |
| 7,886,474 | B2 * | 2/2011 | Werner | F41A 23/16 42/94 |
| 8,234,968 | B2 * | 8/2012 | Hodge | F41A 27/06 89/37.17 |
| 8,322,269 | B2 * | 12/2012 | Sullivan | F41A 27/14 89/41.11 |
| 2016/0102945 | A1 * | 4/2016 | Itzkowitz | F41G 5/16 89/37.14 |

* cited by examiner

ADJUSTABLE SIGHTING AND SHOOTING FIREARM MOUNTING VISE

The current application is a continuation-in-part (CIP) application of a U.S. non-provisional application Ser. No. 15/625,880 filed on Jun. 16, 2017. The U.S. non-provisional application Ser. No. 15/625,880 claims a priority to a U.S. provisional application Ser. No. 62/350,808 filed on Jun. 16, 2016.

FIELD OF THE INVENTION

The present invention relates generally to an apparatus for a remotely controlled sighting-in and shooting device. More specifically, the present invention is a remotely controlled sighting and shooting device used to greatly reduce the human error, as well as, providing recreational shooting opportunities for physically handicapped gun enthusiasts.

BACKGROUND OF THE INVENTION

Firearms are typically used for protection, competition, and recreational use. Proper training to use firearms is important to reduce possible injury or accidental death from unintentional discharge of the firearm. Traditionally, a person being trained is handed a firearm after receiving explanations of how the firearm works and etiquette for safely handling the firearm. New users, particularly younger users, may be unfamiliar with handling the kickback from some firearms recoiling. Uncompensated or improperly compensated recoil may cause direct injury to the shooter or bystander due to a ricocheting bullet.

The present invention is an adjustable sighting and shooting firearm mounting vise. The present invention greatly reduces human error associated with manually sighting-in a weapon, to facilitate the sighting-in process, to provide recreational training and shooting opportunities for young shooters, and to provide recreational shooting opportunities for physically handicapped gun enthusiasts. The present invention spares the shooter from recoil by securing the firearm to the present invention. Further, the present invention is able to be activated remotely to spare the shooter from the loud noises associated with the discharge of the fire arm.

DETAIL DESCRIPTIONS OF THE INVENTION

All illustrations of the drawings are for the purpose of describing selected versions of the present invention and are not intended to limit the scope of the present invention.

The present invention is an adjustable sighting and shooting firearm mounting vise. The present invention assists young and handicap shooters with learning and discharging firearms safely. The present invention secures a firearm for the shooter to remotely sight and discharge the firearm, sparing the shooter from recoil and the loud noises associated with discharging a firearm. The present invention assists in removing human error with sighting and discharging the firearm.

Figure 1:
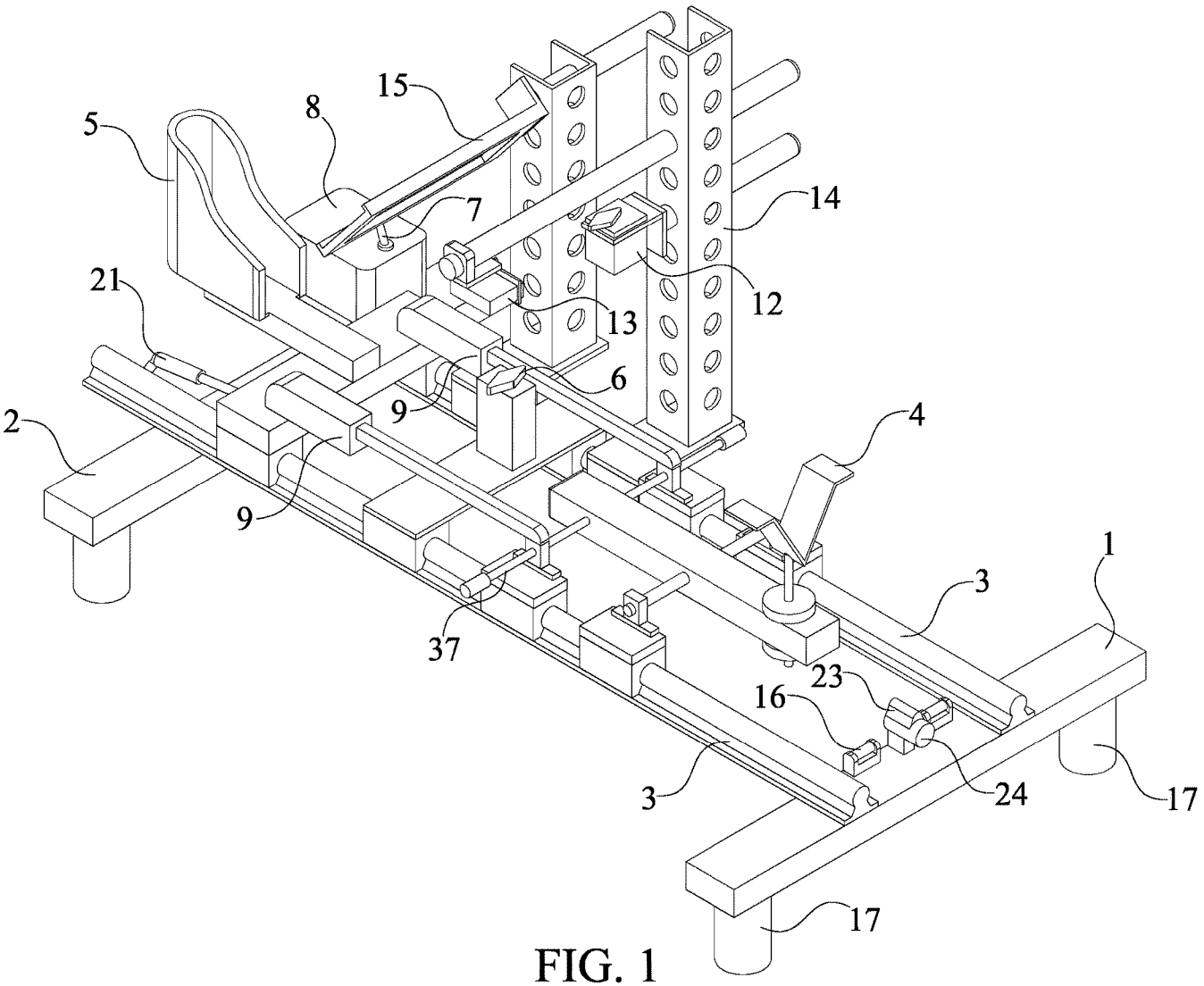
FIG. 1 is a perspective view of the present invention.
Figure 10:
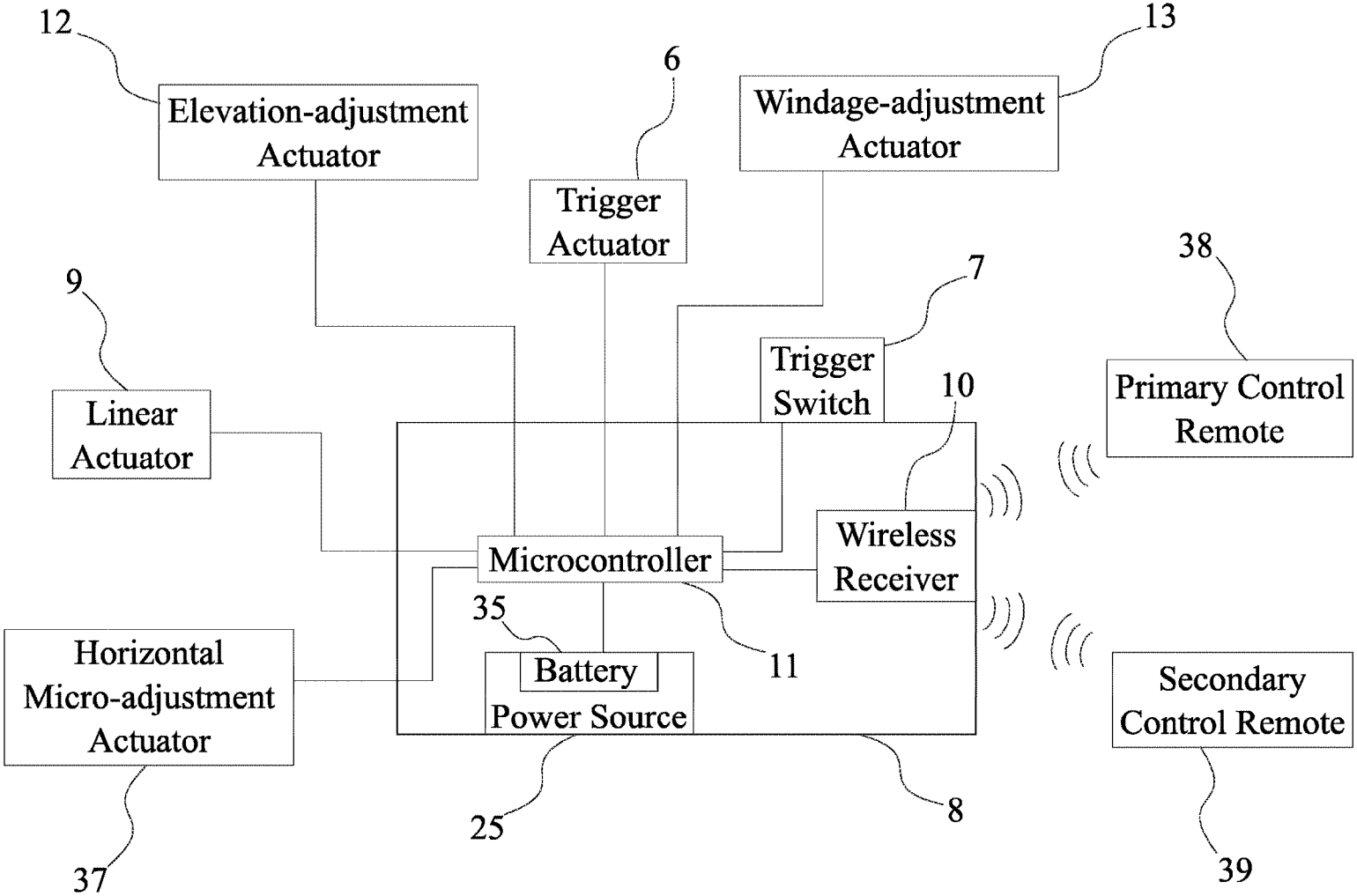
FIG. 10 is schematic diagram showing the connections between electrical components of the present invention, wherein the power source is a battery.
Figure 11:
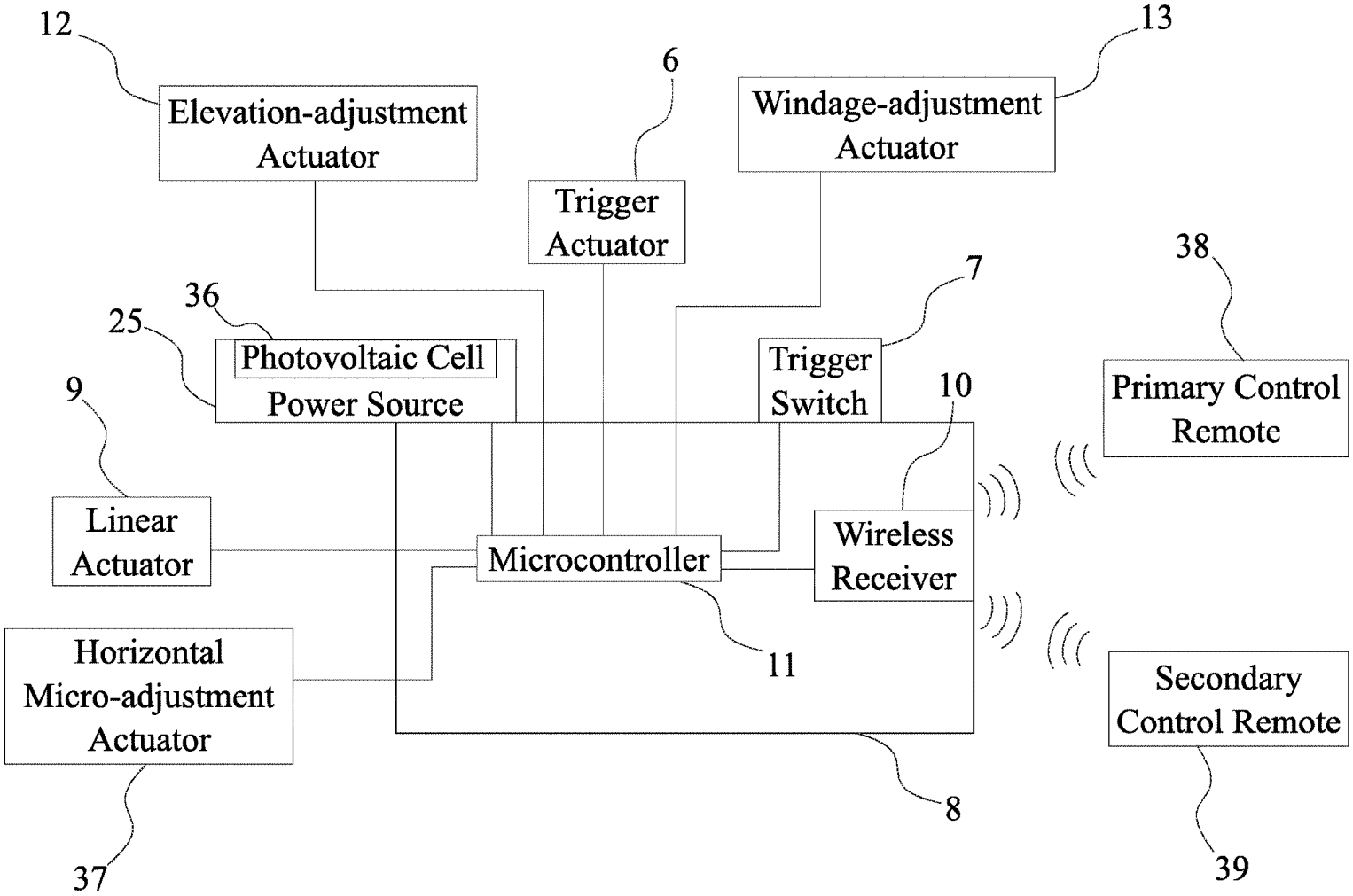
FIG. 11 is schematic diagram showing the connections between electrical components of the present invention, wherein the power source is a battery.

In accordance to FIG. 1, the present invention comprises a forward base support 1, a rear base support 2, a pair of positional-adjustment tracks 3, a forend support 4, a stock support 5, a trigger actuator 6, a trigger switch 7, a controller housing 8, and an at least one linear actuator 9, as well as, a wireless receiver 10 and a microcontroller 11, shown in FIG. 10 and FIG. 11. The forward base support 1 and the rear base support 2 support the pair of positional-adjustment tracks 3 to offset the supported firearm from a horizontal surface, such as a table or ground. The pair of positional-adjustment tracks 3 allows the forend support 4, the stock support 5, the trigger actuator 6, the trigger switch 7, and the controller housing 8 to translate along the pair of positional-adjustment tracks 3, such that the present invention is able to support a plurality of firearms from handguns to long guns. Each positional-adjustment track 3 is adjacently connected to the forward base support 1. Similarly, each positional-adjustment track 3 is adjacently connected to the rear base support 2. The forward base support 1 is oppositely positioned to the rear base along each positional-adjustment track 3, such that weight of the forend support 4, the stock support 5, the trigger actuator 6, the trigger switch 7, the controller housing 8, a wireless receiver 10, and a microcontroller 11 is evenly supported on a horizontal surface. The forend support 4 and the trigger actuator 6 are slideably engaged to one of the positional-adjustment tracks 3, such that the forend support 4 and the trigger actuator 6 are able to translate along the corresponding positional-adjustment track 3, such that the shooter is able to easily manipulate the forend support 4 and the trigger actuator 6 to accommodate the shooter's firearm. The forend support 4 supports the forend or barrel of a rifle, carbine, or other long gun. A stock of the firearm is secured to the stock support 5 to compensate for recoil of the firearm as traditionally by a shooter's shoulder. The stock support 5 is slideably mounted between each positional-adjustment track 3. In this configuration, the stock support 5 is able to translate simultaneously along each positional-adjustment track 3, and the stock support 5 is supported evenly between each positional-adjustment track 3.

The trigger actuator 6 engages the trigger of the firearm to discharge the firearm when selectively activated by the shooter. The trigger actuator 6 is positioned between the stock support 5 and the forend support 4 such that the trigger actuator 6 can effectively engage the trigger of the secured firearm. The at least one linear actuator 9 displaces the stock support 5 from the forend support 4 to receive the firearm. The at least one linear actuator 9 is adjacently connected between the stock support 5 and the forend support 4 in order to allow the shooter to adjust the relative distance between the forend support 4 and the stock support 5.

The controller housing 8 supports a plurality of electrical components including the wireless receiver 10 and the microcontroller 11, shown in FIG. 10 and FIG. 11. The controller housing 8 is slideably mounted to one of the positional-adjustment tracks 3 to allow the shooter to adjust the position of the controller housing 8 along the corresponding positional-adjustment track 3. The trigger switch 7 initiates a control signal to actuate the trigger actuator 6 to discharge the firearm. The trigger switch 7 is adjacently connected to the controller housing 8 to be accessible to the shooter. The wireless receiver 10 and the microcontroller 11 are internally mounted to the controller housing 8, in order to protect the wireless receiver 10 and the microcontroller 11 from dust, debris, or other environmental hazards. The trigger actuator 6, the trigger switch 7, the at least one linear actuator 9, and the wireless receiver 10 are electronically connected to the microcontroller 11 to allow the microcontroller 11 to process and distribute control signals between the trigger actuator 6, the trigger switch 7, the at least one linear actuator 9, and the wireless receiver 10.

In accordance to the preferred embodiment of the present invention, the present invention comprises an elevation-adjustment actuator 12, detailed in FIG. 1 to FIG. 4, and FIG. 8 to FIG. 11. The elevation-adjustment actuator 12 interfaces with a firearm scope to manipulate an elevation-adjustment knob of the scope to adjust the vertical sighting of the firearm. The elevation-adjustment actuator 12 is mounted to one of the positional-adjustment tracks 3. The elevation-adjustment actuator 12 is offset from the pair of positional-adjustment tracks 3. Therefore, the elevation-adjustment actuator 12 is suspended above the pair of positional-adjustment tracks 3 during implementation of the present invention, such that the elevation-adjustment actuator 12 is able to engage the elevation-adjustment knob for a scope of a firearm secured by the present invention. The elevation-adjustment actuator 12 is electronically connected to the microcontroller 11, such that the elevation-adjustment actuator 12 receives control signals from the microprocessor to adjust the elevation-adjustment knob.

Further in accordance to the preferred embodiment of the present invention, the present invention comprises a windage-adjustment actuator 13, shown in FIG. 1, FIG. 8, FIG. 10, and FIG. 11. Similar to the elevation-adjustment actuator 12, the windage-adjustment actuator 13 interfaces with a firearm scope to manipulate a windage-adjustment knob of the scope to adjust the horizontal sighting of the firearm. The windage-adjustment actuator 13 is mounted to one of the positional-adjustment tracks 3 and the windage-adjustment actuator 13 is offset from the pair of positional-adjustment tracks 3, such that the windage-adjustment actuator 13 is suspended above the pair of positional-adjustment tracks 3 during implementation of the present invention. Therefore, the windage-adjustment actuator 13 is able to be positioned to engage the windage-adjustment knob for the scope of a firearm secured by the present invention. The windage-adjustment actuator 13 is electronically connected to the microcontroller 11, such that the windage-adjustment actuator 13 receives control signals from the microcontroller 11 to adjust the windage-adjustment knob to sight the scope.

For a more specific embodiment of the present invention, the present invention comprises a sighting support 14, in accordance to FIG. 1 to FIG. 6. The sighting support 14 supports the weight of the elevation-adjustment actuator 12 and the windage-adjustment actuator 13. The sighting support 14 is slideably connected to one of the positional-adjustment tracks 3, such that the sighting support 14 is able to translate along the corresponding positional-adjustment track 3. The elevation-adjustment actuator 12 and the windage-adjustment actuator 13 are mounted to the corresponding positional-adjustment track 3 through the sighting support 14. Therefore, the translation of the sighting support 14 along the corresponding positional-adjustment track 3 allows the elevation-adjustment actuator 12 and the windage-adjustment actuator 13 to be positioned adjacent to the scope for a plurality of scoped firearms.

For some embodiments of the present invention, the present invention comprises a scope-display mount 15, shown in FIG. 1 to FIG. 4. The scope-display mount 15 supports a display device, such as a smartphone or camera, that indirectly displays the view through the scope. Thus, the view through the scope is able to be enlarged using the display device. Additionally, this indirect view through the scope allows the shooter to be at a distance from the scope as the firearm is discharged, therefore preventing the shooter from being injured due to recoil of the firearm as the firearm is discharged. The scope-display mount 15 is slideably mounted to the positional-adjustment tracks, similar to the elevation-adjustment actuator 12 and the windage-adjustment actuator 13. The scope-display mount 15 is offset from the pair of positional-adjustment tracks 3, and the scope-display mount 15 is positioned between the stock support 5 and the forend support 4. This configuration allows the scope-display mount 15 to be positioned adjacent and oriented towards to a lens of the scope to display the view through the scope down range of the firearm.

Figure 2:
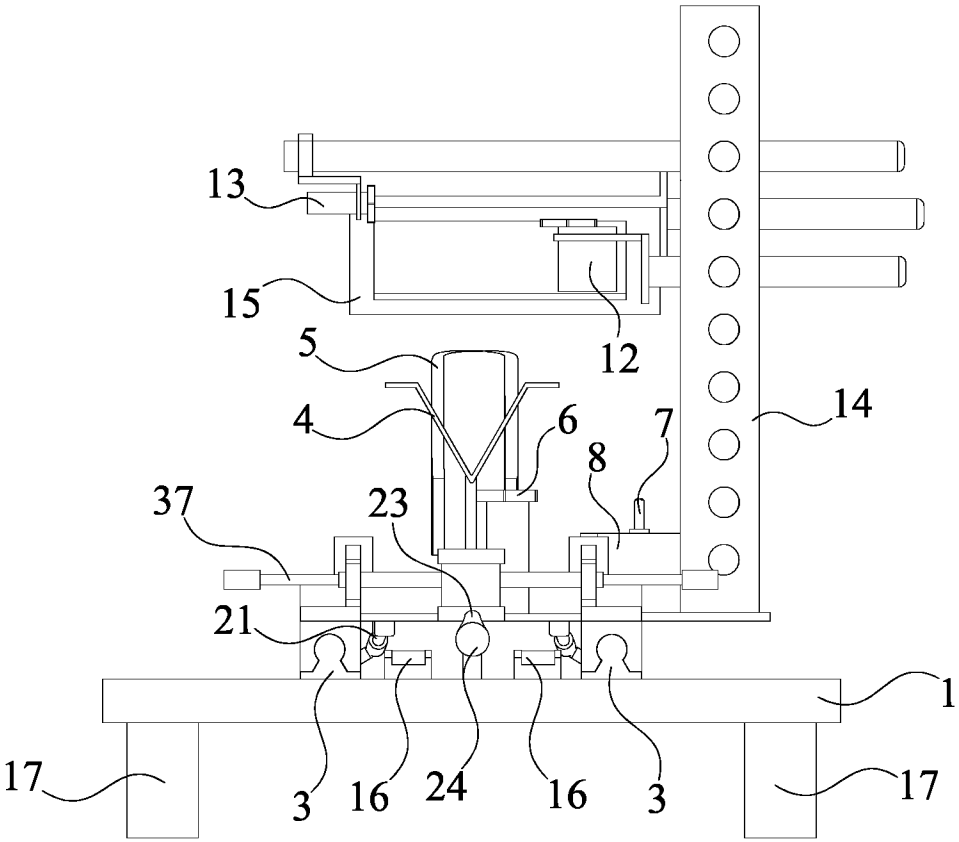
FIG. 2 is a front view of the present invention.
Figure 3:
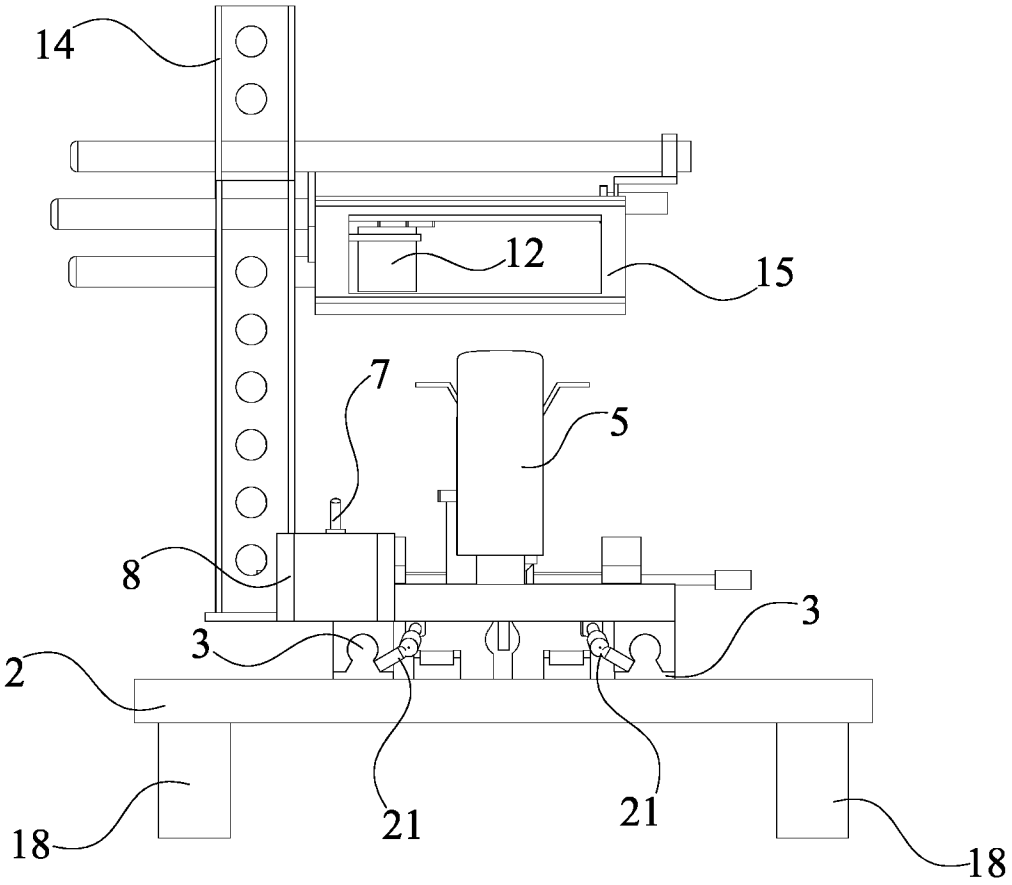
FIG. 3 is a rear view of the present invention.
Figure 4:
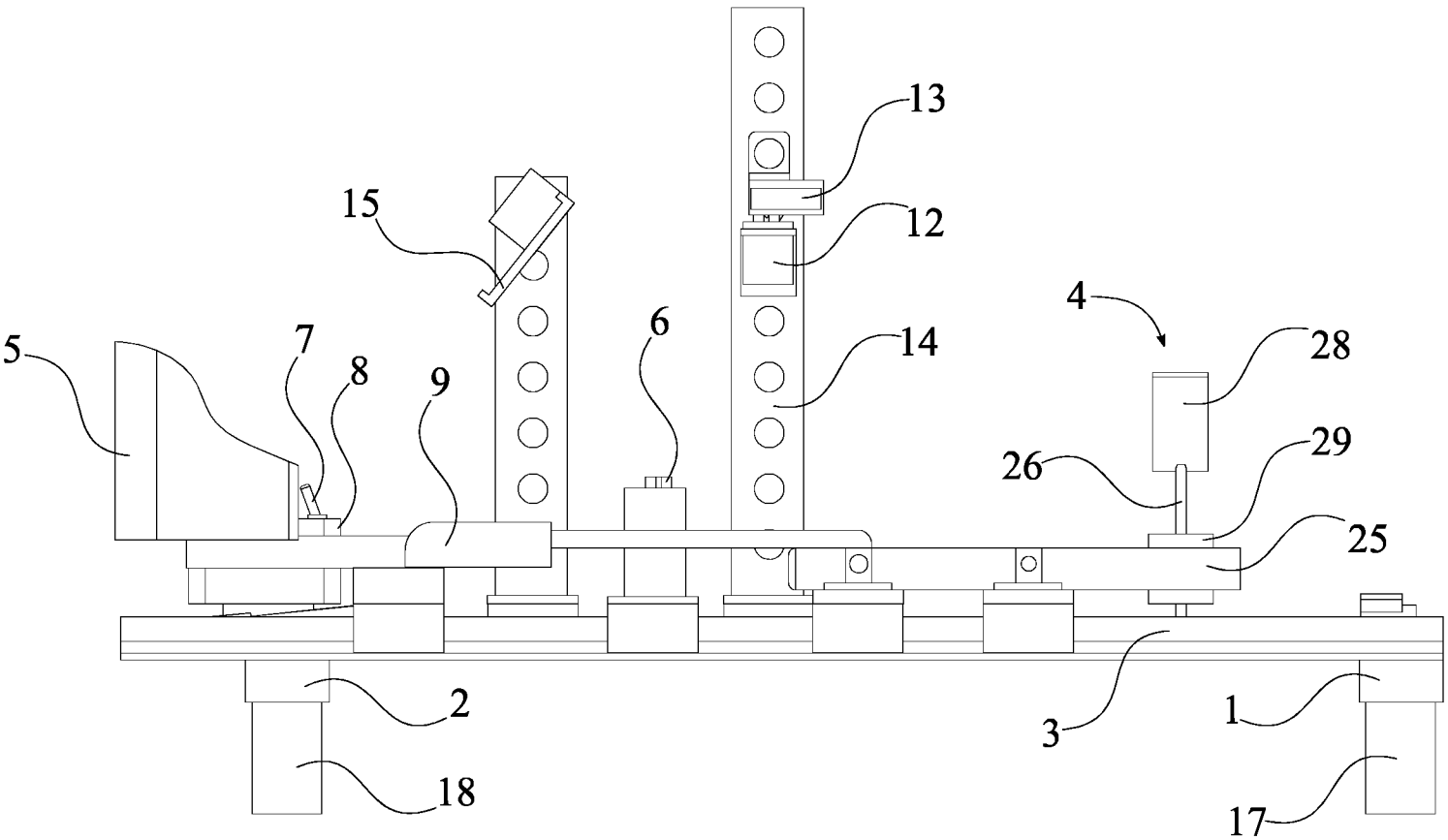
FIG. 4 is a left view of the present invention.
Figure 6:
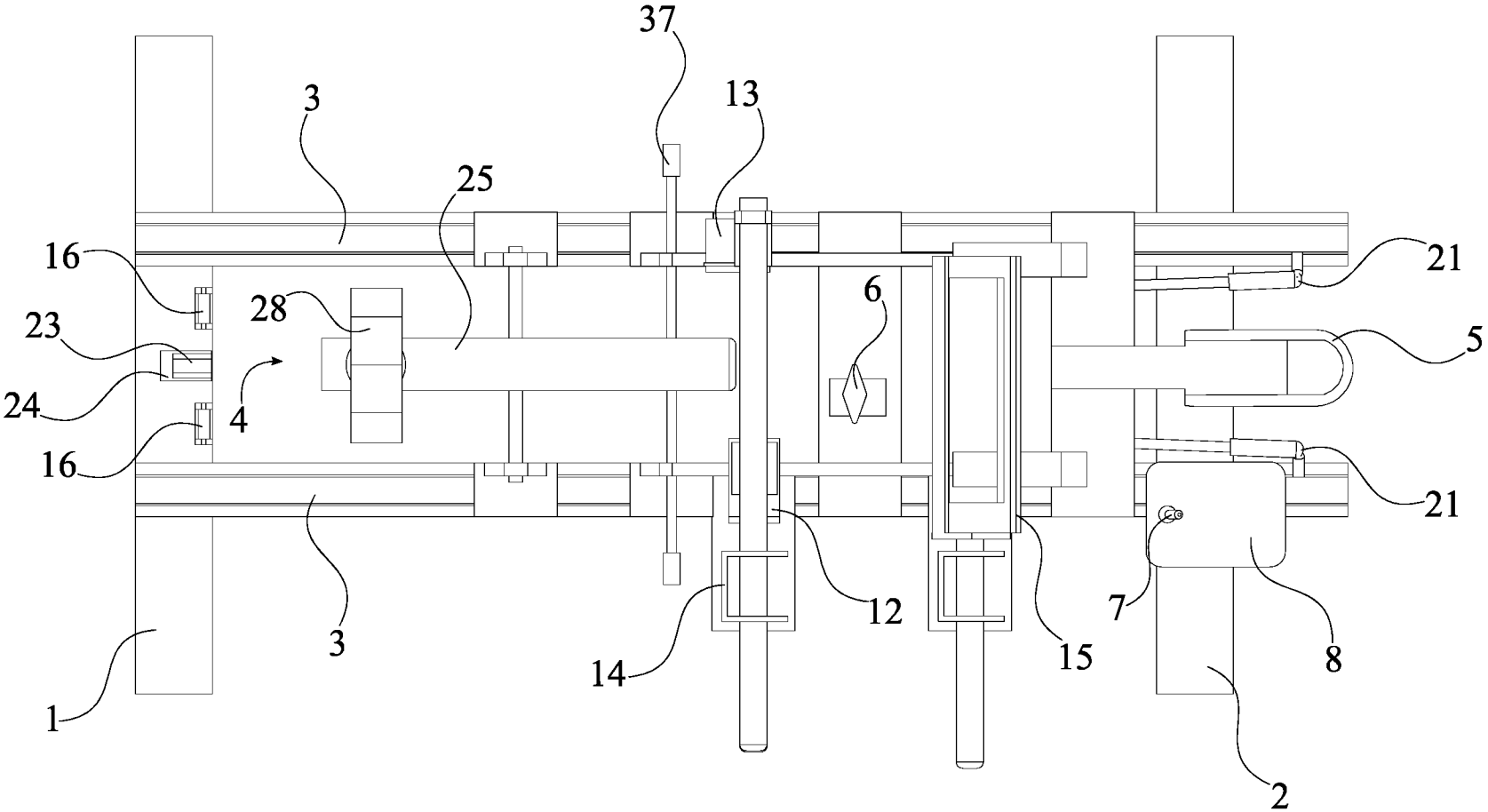
FIG. 6 is a top view of the present invention.
Figure 7:
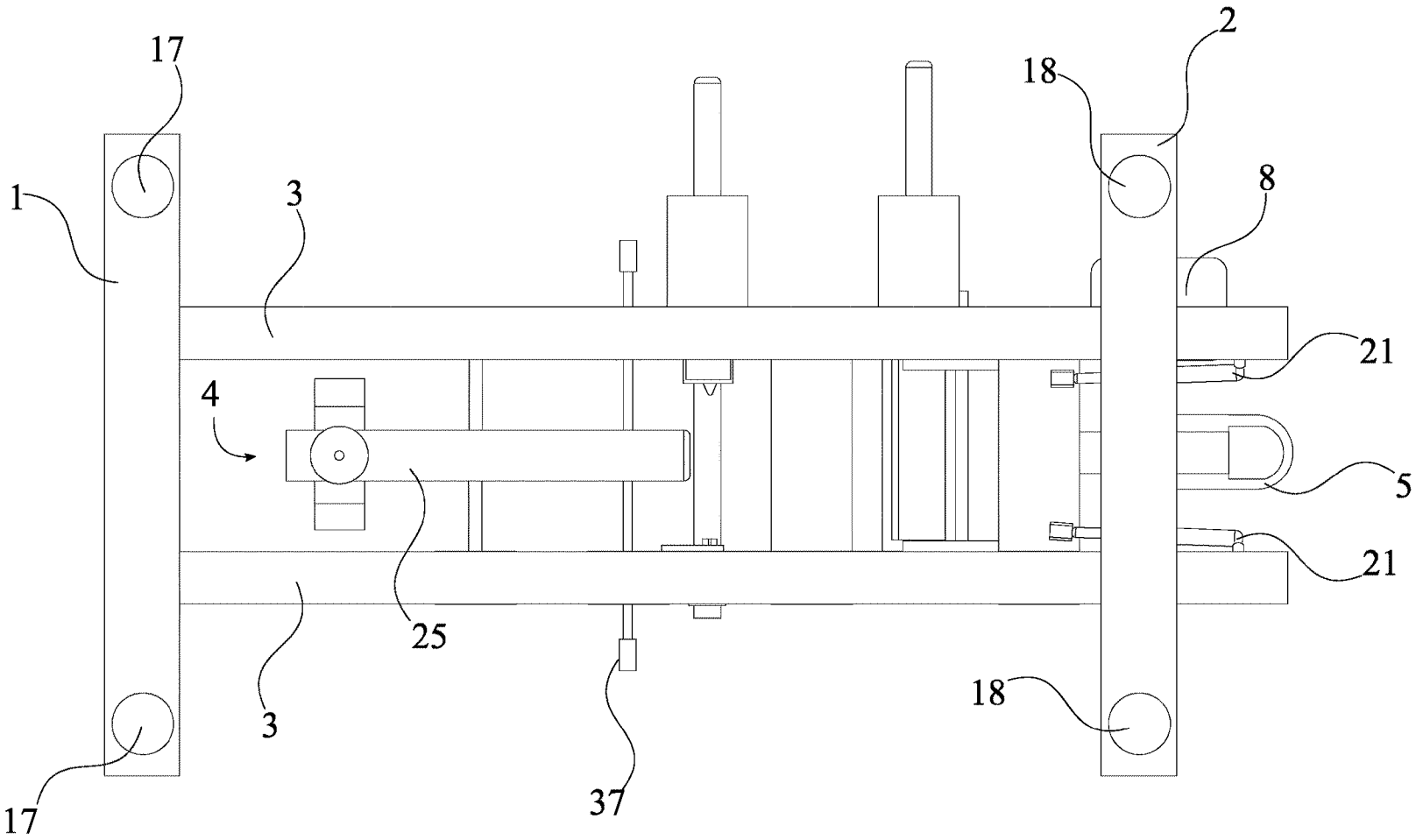
FIG. 7 is a bottom view of the present invention.

Further in accordance to preferred embodiment of the present invention, the present invention comprises a level indicator 16 mounted to the forward base support 1, shown in FIG. 1, FIG. 2 and FIG. 6. The level indicator 16 displays the pitch of the forward base support 1 with respect to the horizontal surface that the present invention is resting on to allow the shooter to adjust for the pitch when sighting the firearm.

For some embodiments of the present invention, the present invention comprises a first pair of adjustable leveling feet 17 and a second pair of adjustable leveling feet 18, detailed in FIG. 2 to FIG. 5, and FIG. 7. The first pair of adjustable leveling feet 17 and a second pair of adjustable leveling feet 18 allow the shooter to adjust the height of the forward base support 1 and the rear base support 2, respectfully. The first pair of adjustable leveling feet 17 is mounted to the forward base support 1. The first pair of adjustable leveling feet 17 is oppositely oriented to the pair of positional-adjustment tracks 3 about the forward base support 1, such that the first pair of adjustable leveling feet 17 interfaces with surface that the present invention rests during implementation. Each adjustable leveling foot 17 is oppositely positioned to the other along the forward base support 1. Similarly, the second pair of adjustable leveling feet 18 is mounted to the rear base support 2. The second pair of adjustable leveling feet 18 is oppositely oriented to the pair of positional-adjustment tracks 3 about the rear base support 2, such that the second pair of adjustable leveling feet 18 interfaces with surface that the present invention rests during implementation. Each adjustable leveling foot 18 is oppositely positioned to the other along the rear base support 2.

Figure 8:
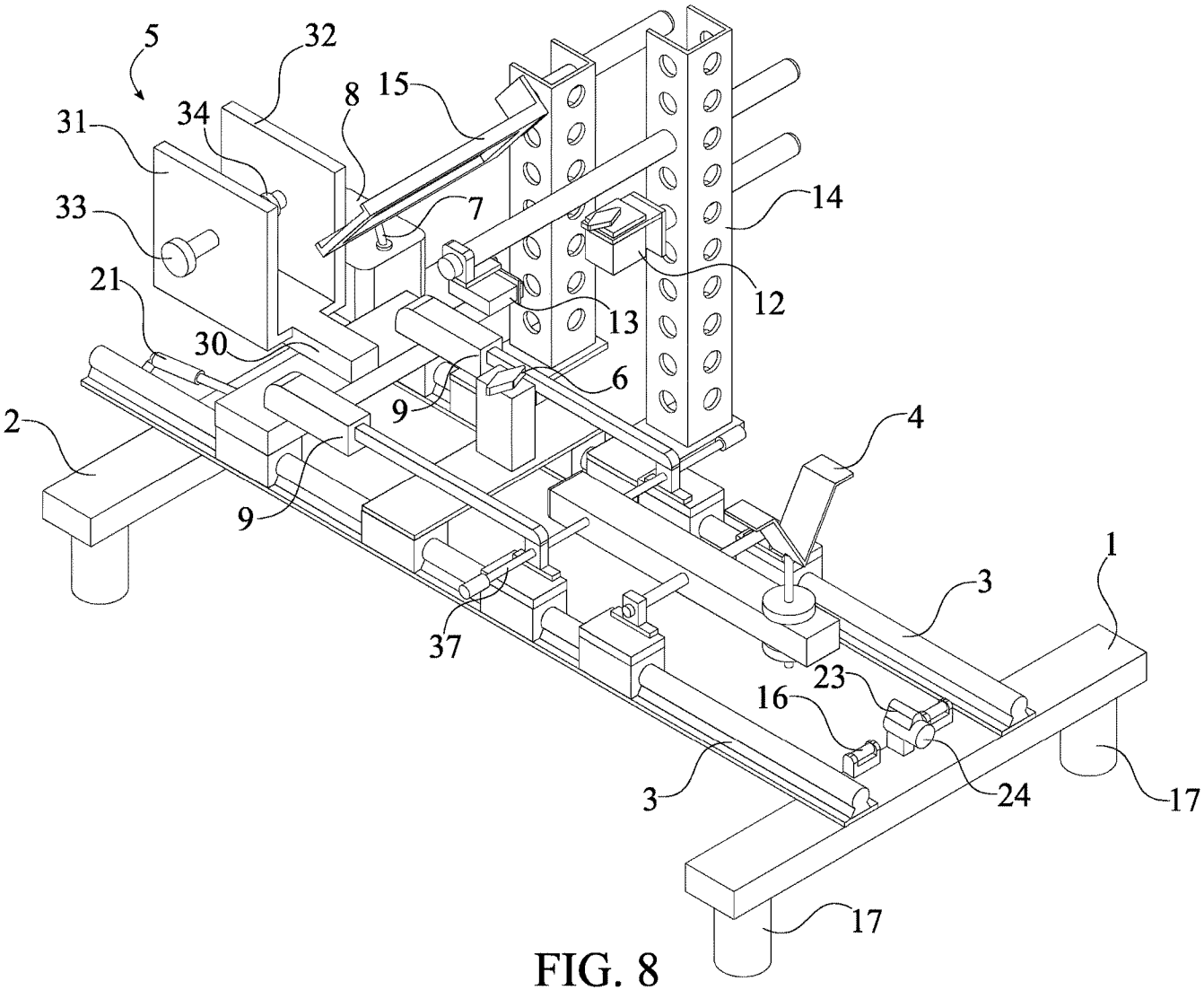
FIG. 8 is a perspective view of an alternate embodiment for the stock support of the present invention.
Figure 9:
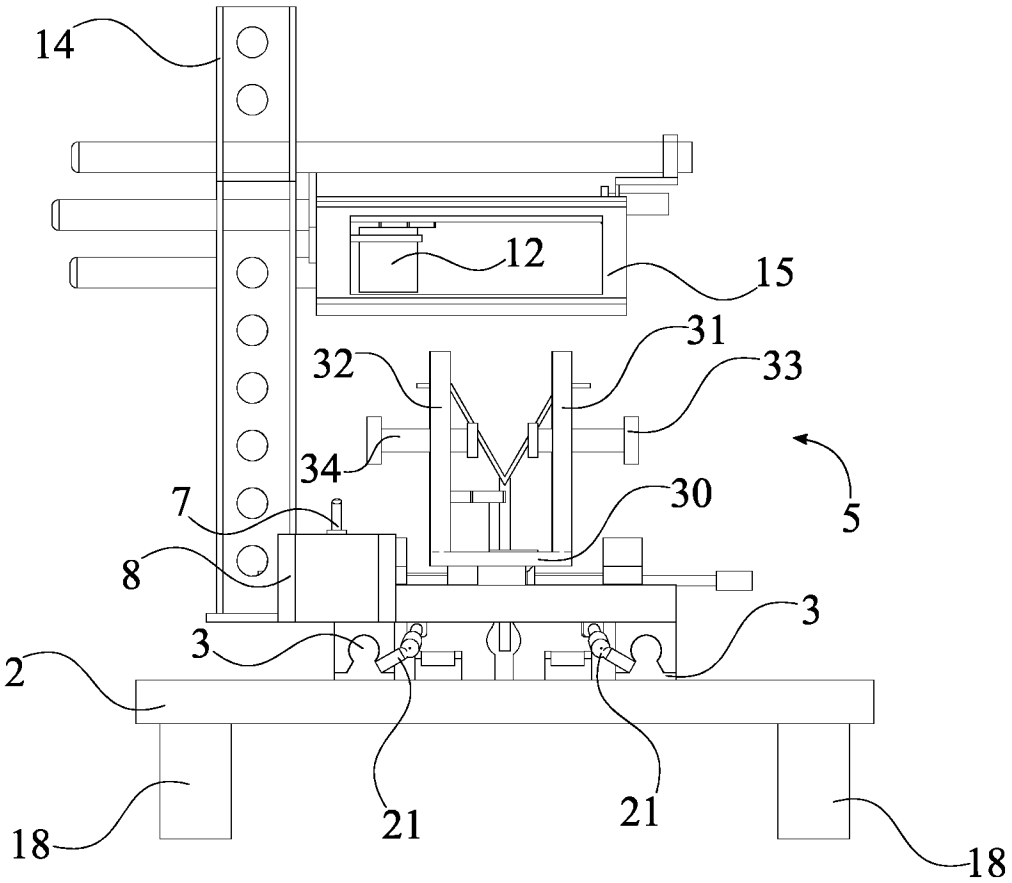
FIG. 9 is a rear view of an alternate embodiment for the stock support of the present invention.

In accordance to an alternate embodiment of the stock support 5, the stock support 5 comprises a stock mount 30, a first vise support 31, a second vise support 32, a first stock-vise fastener 33, and a second stock-vise fastener 34, shown in FIG. 8 and FIG. 9. The stock mount 30 supports the first vise support 31 and the second vise support 32 across the pair of positional-adjustment tracks 3. The stock mount 30 is slideably engaged with each of the pair of positional-adjustment tracks 3, to allow the stock mount 30 to translate along the pair of positional-adjustment tracks 3. The first vise support 31 and the second vise support 32 sustain the weight for a stock of the firearm as the first stock-vise fastener 33 and the second stock-vise fastener 34 apply pressure to the stock from opposing sides of the stock.

The first vise support 31 and the second vise support 32 are adjacently connected to the stock support 5. The first vise support 31 and the second vise support 32 are oriented normal to the stock mount 30. The first vise support 31 and the second vise support 32 are offset from each other, such that the stock is received between the first vise support 31 and the second vise support 32. The first stock-vise fastener 33 is threadedly engaged through the first vise support 31. Similarly, the second stock-vise fastener 34 is threadedly engaged through the second vise support 32. This configuration allows the first stock-vise fastener 33 and the second stock-vise fastener 34 to engage the stock to apply pressure from either side of the stock, therefore securing the stock between the first vise support 31 and the second vise support 32. More specifically, the first stock-vise fastener 33 threadedly engages the first vise support 31, such that the first stock-vise fastener 33 is adjustable through the first vise support 31 to accommodate a plurality of firearm stocks. Similarly, the second stock-vise fastener 34 threadedly engages the second vise support 32, such that the second stock-vise fastener 34 is adjustable through the second vise support 32 to accommodate a plurality of firearm stocks.

In some embodiments of the present invention, the present invention comprises a recoil-restraint strap 19, shown in FIG. 9. The recoil-restraint strap 19 restrains the firearm at the stock during recoil of the firearm as its discharged. The recoil-restraint strap 19 is laterally connected between the first vise support 31 and the second vise support 32 in order to distribute the force from the recoil to the first vise support 31 and the second vise support 32 through the recoil-restraint strap 19. In some other more specific embodiments of the present invention, the present invention comprises a stock rest 20. The stock rest 20 provides additional support for the weight of the stock as the shooter is securing the stock between the first stock-vise fastener 33 and the second stock-vise fastener 34. The stock rest 20 is connected between the first vise support 31 and the second vise support 32. The stock rest 20 is offset from the stock mount 30, such that the firearm is displaced from the stock mount 30 to prevent damage to the stock mount 30 or firearm as the firearm is discharged.

Figure 5:
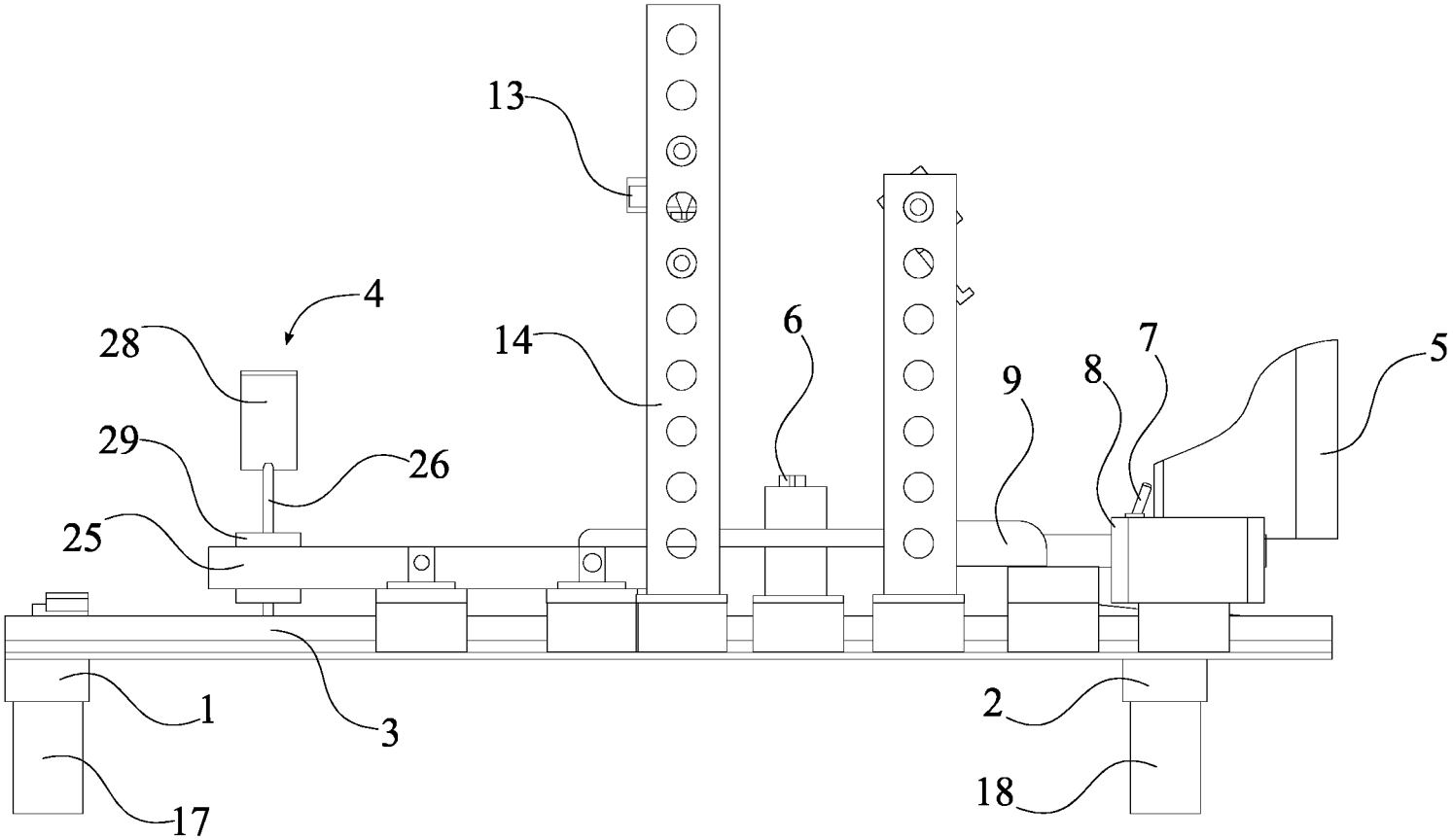
FIG. 5 is a left view of the present invention.

In accordance to the preferred embodiment of the forend support 4, the forend support 4 comprises a forend support base 25, a height-adjustment support 26, a forend receiving channel 28, and a height-adjustment mechanism 29, shown in FIG. 5 and FIG. 6. The forend support base 25 supports the height-adjustment support 26, the forend receiving channel 28, and the height-adjustment mechanism 29 on the pair of positional-adjustment tracks 3. The forend support base 25 is slideably connected to the pair of positional-adjustment tracks 3, in order to allow the forend support 4 to accommodate firearms with a plurality of forends or a plurality of barrels for long guns. The height-adjustment support is adjacently connected to the forend support base 25. The height-adjustment support 26 is oriented normal to the forend support base 25, in order to support the forend receiving channel 28. The forend receiving channel 28 is adjacently connected to the height-adjustment support 26 opposite to the forend support base 25. The height-adjustment mechanism 29 is connected between the forend receiving channel 28 and the forend support base 25, such that the forend receiving channel 28 is adjustable along the height-adjustment support 26. Adjusting the position of the forend receiving channel 28 subsequently adjusts the angle of the barrel of the firearm vertically from the forend support base 25.

In some more specific embodiments of the present invention, the forend support base 25 is slideably engaged with each positional-adjustment track 3 through a horizontal micro-adjustment actuator 37. The forend support base 25 is pivotably connected to the horizontal micro-adjustment actuator 37, centrally between each positional-adjustment track 3. The horizontal micro-adjustment actuator 37 allows the shooter to adjust the aim of the firearm horizontally by small increments. The horizontal micro-adjustment actuator 37 is electronically connected to the microcontroller 11 to receive control signals from the microcontroller 11 to precisely control the horizontal adjustment of the firearm.

In some embodiments of the present invention, the present invention further comprises at least one recoil shock 21, in accordance to FIG. 1 to FIG. 3 and FIG. 6 to FIG. 9. The at least one recoil shock 21 dampens the recoil of discharging the firearm. The at least one recoil shock 21 is connected between the one of the positional-adjustment tracks 3 and the stock support 5. The at least one recoil shock 21 is positioned opposite to the forward base support 1, such that the at least one recoil shock 21 is able to compensates for the recoil from discharging the firearm.

In accordance to the preferred embodiment of the present invention, the present invention comprises a primary control remote 38, in accordance to FIG. 10 and FIG. 11. The primary control remote 38 is a remote device, such as a smartphone, a long-range radio frequency (RF) device, a short-range RF device, or any similar remote-control device, that allows the shooter to adjust the at least one linear actuator 9, the elevation-adjustment actuator 12, the windage-adjustment actuator 13, and he horizontal micro-adjustment actuator 37, as well as to remotely initiate the trigger actuator 6 to discharge the firearm. The primary control remote 38 is communicatively coupled with the wireless receiver 10 to receive a control signal to adjust the at least one linear actuator 9, the elevation-adjustment actuator 12, the windage-adjustment actuator 13, and the horizontal micro-adjustment actuator 37, or initiate the trigger actuator 6. The primary control remote 38 is preferred to be used by the shooter.

More specifically, the present invention further comprises a secondary control remote 39, shown in FIG. 10 and FIG. 11. The secondary control remote 39 similarly functions like the primary control remote 38, although the control signals from the secondary control remote 39 supersede the control signals from the primary control remote 38. The secondary control remote 39 is communicatively coupled with the wireless receiver 10, similar to the primary control remote 38. The secondary control remote 39 is preferred to be used by an instructor. The instructor is able to use the secondary control remote 39 to prevent the microcontroller 11 from processing control signals from the primary control remote 38, such as the initiation of the trigger actuator 6, until the instructor is confident the shooter followed the proper steps to prepare to discharge the firearm.

Further in accordance to FIG. 10 and FIG. 11, the present invention comprises a power source 22 to provide electrical energy to the trigger actuator 6, the at least one linear actuator 9, the wireless receiver 10, the microcontroller 11, the elevation-adjustment actuator 12, and the windage-adjustment actuator 13. In some embodiments, the power source 22 is preferred to be a battery 35. The battery 35 is internally mounted to the controller housing 8. The battery 35 is electrically connected to the microcontroller 11 such that electrical power is distributed to the at least one linear actuator 9, the elevation-adjustment actuator 12, the windage-adjustment actuator 13, the horizontal micro-adjustment actuator 37, the trigger actuator 6, and the wireless receiver 10. In another embodiment of the present invention, the power source 22 is a photovoltaic cell 36. The photovoltaic cell 36 similarly provides electrical power the trigger actuator 6, the at least one linear actuator 9, the wireless receiver 10, the microcontroller 11, the elevation-adjustment actuator 12, and the windage-adjustment actuator 13. The photovoltaic cell 36 is externally mounted to the controller housing 8 in order to receive sunlight to convert the sunlight into electricity.

In some embodiments of the present invention, the present invention comprises a laser sight 23, shown in FIG. 1, FIG. 2, FIG. 6, and FIG. 8. The laser sight 23 assists the shooter in sighting the firearm. The laser sight 23 is adjacently connected to the forward base support 1. The laser sight 23 is positioned between each positional-adjustment track 3. The laser sight 23 is oriented away from the rear base support 2 to emit the laser in the direction of projectile discharge. The laser sight 23 allows the shooter to direct the firearm and the present invention in the general direction of the target. The first pair of adjustable leveling feet 17, the second pair of adjustable leveling feet 18, and the horizontal micro-adjustment actuator 37 would then be adjusted to precisely aim the firearm.

Still in accordance to some other embodiments of the present invention, the present invention comprises a flashlight 24, detailed in FIG. 1, FIG. 2, FIG. 6, and FIG. 8. The flashlight 24 illuminates an area in the direction of the projectile discharge. The flashlight 24 is adjacently connected to the forward base support 1. The flashlight 24 is positioned between each positional-adjustment track 3. The flashlight 24 is oriented away from the rear base support 2 in order to illuminate an area in the direction of the projectile discharge in dim or darkly lit situations.

Although the invention has been explained in relation to its preferred embodiment, it is to be understood that many other possible modifications and variations can be made without departing from the spirit and scope of the invention as hereinafter claimed.

What is claimed is:

1. An adjustable sighting and shooting firearm mounting vise comprising:

a pair of positional-adjustment tracks being connected to a forward base support;

each positional-adjustment track being connected to a rear base support;

the forward base support being oppositely positioned to the rear base support along each positional-adjustment track;

a forend support and a trigger actuator slideably engaging one of the positional-adjustment tracks;

a stock support being slideably mounted to each positional-adjustment track;

the stock support being positioned between the pair of positional-adjustment tracks;

the trigger actuator being positioned between the pair of positional-adjustment tracks;

the trigger actuator being positioned between the stock support and the forend support;

at least one linear actuator being positioned between the stock support and the forend support;

a controller housing being slideably mounted to one of the positional-adjustment tracks;

a trigger switch being connected to the controller housing;

a wireless receiver and a microcontroller being internally mounted to the controller housing; and the trigger switch, the wireless receiver, the trigger actuator, and the at least one linear actuator being electronically connected to the microcontroller.

2. The adjustable sighting and shooting firearm mounting vise, as claimed in claim 1, comprising:

an elevation-adjustment actuator being mounted to one of the positional-adjustment tracks;

the elevation-adjustment actuator being offset from the pair of positional-adjustment tracks; and the elevation-adjustment actuator being electronically connected to the microcontroller.

3. The adjustable sighting and shooting firearm mounting vise, as claimed in claim 1, comprising:

a windage-adjustment actuator being mounted to one of the positional-adjustment tracks;

the windage-adjustment actuator being offset from the pair of positional-adjustment tracks; and the windage-adjustment actuator being electronically connected to the microcontroller.

4. The adjustable sighting and shooting firearm mounting vise, as claimed in claim 1, comprising:

a sighting support being slideably connected to one of the positional-adjustment tracks; and an elevation-adjustment actuator and a windage-adjustment actuator being mounted to the positional-adjustment track through the sighting support.

5. The adjustable sighting and shooting firearm mounting vise, as claimed in claim 1, comprising:

a scope-display mount being slideably mounted to one of the positional-adjustment tracks;

the scope-display mount being offset from the pair of positional-adjustment tracks; and the scope-display mount being positioned between the stock support and the forend support.

6. The adjustable sighting and shooting firearm mounting vise, as claimed in claim 1, comprising:

a level indicator mounted to the forward base support; and the level indicator being positioned between each of the pair of positional-adjustment tracks.

7. The adjustable sighting and shooting firearm mounting vise, as claimed in claim 1, comprising:

a first pair of adjustable leveling feet being mounted to the forward base support;

the first pair of adjustable leveling feet being oppositely oriented with the pair of positional-adjustment tracks about the forward base support; and each adjustable leveling foot being oppositely positioned to the other along the forward base support.

8. The adjustable sighting and shooting firearm mounting vise, as claimed in claim 1, comprising:

a second pair of adjustable leveling feet being mounted to the rear base support;

the second pair of adjustable leveling feet being oppositely oriented with the pair of positional-adjustment tracks about the rear base support; and each adjustable leveling foot being oppositely positioned to the other along the rear base support.

9. The adjustable sighting and shooting firearm mounting vise, as claimed in claim 1, comprising:

the stock support comprising a stock mount, a first vise support, a second vise support, a first stock-vise fastener, and a second stock-vise fastener;

the stock mount being slideably engaged with each of the pair of positional-adjustment tracks;

the first vise support and the second vise support being connected to the stock mount;

the first vise support and the second vise support being oriented normal to the stock mount the first vise support and the second vise support being offset from each other;

the first stock-vise fastener being threadedly engaged through the first vise support; and the second stock-vise fastener being threadedly engaged through the second vise support.

10. The adjustable sighting and shooting firearm mounting vise, as claimed in claim 9, comprising:

a recoil-restraint strap being laterally connected between the first vise support and the second vise support.

11. The adjustable sighting and shooting firearm mounting vise, as claimed in claim 9, comprising:

a stock rest being connected between the first vise support and the second vise support; and the stock rest being offset from the stock mount.

12. The adjustable sighting and shooting firearm mounting vise, as claimed in claim 1, comprising:

the forend support comprising a forend support base, a height-adjustable support and a forend receiving channel;

the forend support base being slideably connected to between each positional-adjustment track;

the height-adjustable support being connected to the forend support base;

the height-adjustable support being oriented normal to the forend support base; and the forend receiving channel being connected to the height-adjustable support, opposite to the forend support base.

13. The adjustable sighting and shooting firearm mounting vise, as claimed in claim 12, comprising:

the forend support base being slideably engaged with each of the pair of positional-adjustment tracks through a horizontal micro-adjustment actuator;

the forend support base being centrally and pivotably connected to the horizontal micro-adjustment actuator, between each positional-adjustment track; and the horizontal micro-adjustment actuator being electronically connected to the microcontroller.

14. The adjustable sighting and shooting firearm mounting vise, as claimed in claim 1, comprising:

an at least one recoil shock being connected between the stock support and one of the positional-adjustment tracks; and the at least one recoil shock being positioned opposite to the forward base support about the stock support.

15. The adjustable sighting and shooting firearm mounting vise, as claimed in claim 1, comprising:

a power source being electrically connected to the microcontroller.

16. The adjustable sighting and shooting firearm mounting vise, as claimed in claim 15, comprising:

the power source being a battery; and the battery being internally mounted to the controller housing.

17. The adjustable sighting and shooting firearm mounting vise, as claimed in claim 15, comprising:

the power source being a photovoltaic cell; and the photovoltaic cell being externally mounted to the controller housing.

18. The adjustable sighting and shooting firearm mounting vise, as claimed in claim 1, comprising:

a laser sight being connected to the forward base support;

the laser sight being positioned between the pair of positional-adjustment tracks; and the laser sight being oriented away from the rear base support.

19. The adjustable sighting and shooting firearm mounting vise, as claimed in claim 1, comprising:

a flashlight being connected to the forward base support;

the flashlight being positioned between the pair of positional-adjustment tracks; and the flashlight being oriented away from the rear base support.

* * * * *